US010065779B2

(12) United States Patent
Harmon

(10) Patent No.: US 10,065,779 B2
(45) Date of Patent: Sep. 4, 2018

(54) FOOD TRAY AND PROCESS FOR MAKING SAME

(71) Applicant: INTERSTATE CORRPACK LLC, Cambridge, MD (US)

(72) Inventor: Kathleen Harmon, Blythewood, SC (US)

(73) Assignee: Indevco Plastics, Inc., Doswell, VA (US)

( * ) Notice: Subject to any disclaimer, the term of this patent is extended or adjusted under 35 U.S.C. 154(b) by 39 days.

(21) Appl. No.: 15/423,252

(22) Filed: Feb. 2, 2017

(65) Prior Publication Data

US 2017/0217654 A1 Aug. 3, 2017

Related U.S. Application Data

(60) Provisional application No. 62/290,652, filed on Feb. 3, 2016.

(51) Int. Cl.

| | |
|---|---|
| ***B65D 85/00*** | (2006.01) |
| ***B65D 65/42*** | (2006.01) |
| ***D21J 3/00*** | (2006.01) |
| ***B65D 1/34*** | (2006.01) |
| ***B65D 65/46*** | (2006.01) |

(52) U.S. Cl.

CPC ..... *B65D 65/42* (2013.01); *B65D 1/34* (2013.01); *B65D 65/466* (2013.01); *B65D 85/70* (2013.01); *D21J 3/00* (2013.01)

(58) Field of Classification Search

USPC ..... 206/557, 564, 524.1, 524.3, 524.6

See application file for complete search history.

(56) References Cited

U.S. PATENT DOCUMENTS

| | | | | |
|---|---|---|---|---|
| 2,840,138 | A | 6/1958 | Johnston et al. | |
| 4,752,637 | A | 6/1988 | Israel | |
| 6,103,308 | A | 8/2000 | Floyd et al. | |
| 6,201,053 | B1 | 3/2001 | Dieckmann et al. | |
| 6,846,573 | B2 | 1/2005 | Seydel | |
| 8,455,068 | B2 | 6/2013 | Bugas et al. | |
| 8,551,585 | B2 | 10/2013 | Bugas et al. | |
| 2003/0170408 | A1* | 9/2003 | Egan | B32B 29/00 428/34.2 |
| 2012/0292226 | A1* | 11/2012 | Hilbish | B65D 1/34 206/557 |
| 2014/0120277 | A1* | 5/2014 | Vonfelden | C09D 167/02 428/34.2 |

* cited by examiner

*Primary Examiner* — Jacob K Ackun

(74) *Attorney, Agent, or Firm* — John S. Hale; Gipple & Hale

(57) ABSTRACT

A repulpable moisture resistant protein tray formed of thermo-molded pulp comprised of recycled paper pulp impregnated with a hydrogenated triglyceride. The protein tray has an outer surface coated with an emulsion of styrene acrylic to provide a moisture resistance repulpable and recyclable tray. The protein tray has a flat bottom and an integral sidewall forming an interior volume. An integral edge extends peripherally outward from an upper edge of the sidewall forming a substantially oval shape.

20 Claims, 4 Drawing Sheets

Fig. 1
PRIOR ART
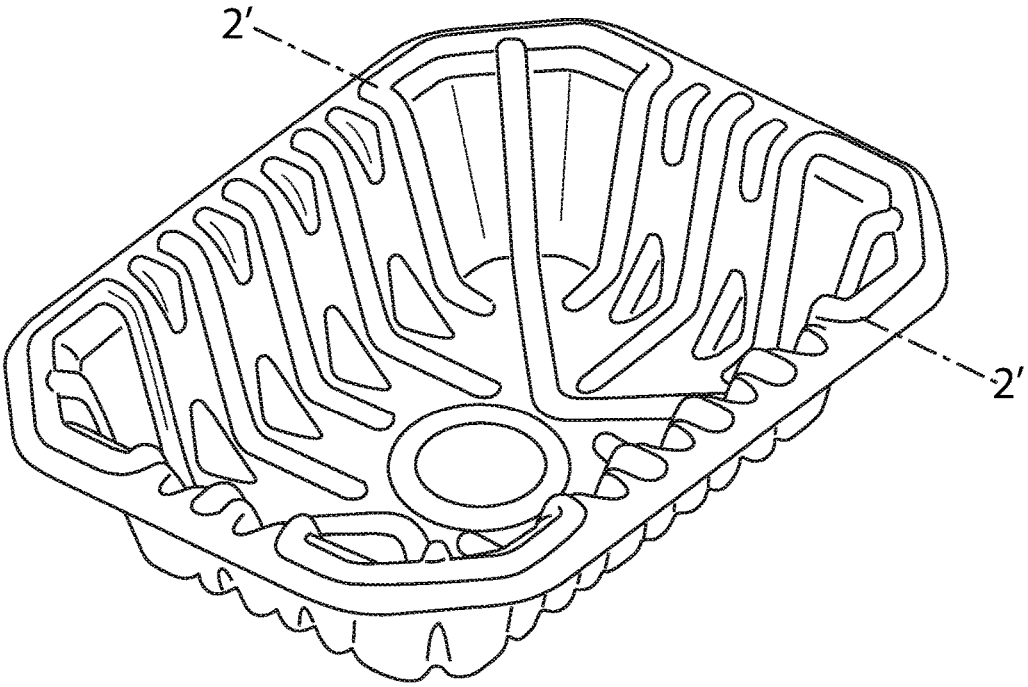
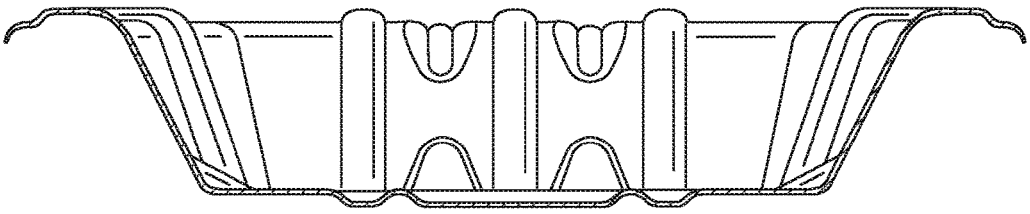
Fig. 2
PRIOR ART

FOOD TRAY AND PROCESS FOR MAKING SAME

RELATED APPLICATIONS

This is a utility patent application claiming priority and benefit from U.S. Provisional Patent Application No. 62/290,652, filed Feb. 3, 2016.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

None.

BACKGROUND OF THE INVENTION

1. Field of the Invention

The present invention generally relates to moisture resistant and water proof paper products utilizing a mixture of recycled paper and recycled paper containing hydrogenated triglycerides. Particularly, this invention relates to moisture resistant paper tray thermo-molded from a mixture of recycled paper pulp and recycled paper originally coated and/or impregnated with hydrogenated triglycerides primarily for use in the protein industry which encompasses poultry, meat and seafood. The tray can be repulped and recycled after use to be part of the feedstock for new paper products.

2. Description of the Related Art

Due to widespread environmental concerns, there has been significant pressure on companies to discontinue the use of polystyrene products in favor of more environmentally safe materials. Some groups have favored the use of products such as paper or other products made from wood pulp. However, there are drawbacks to the sole use of paper due to the tremendous amount of energy that is required to produce it and limited applications of same. Thus, there remains a need to find new, easily degradable materials that meet necessary performance standards.

Degradability is a relative term. Some products which appear to be degraded merely break apart into very small pieces. These small pieces are hard to see, but can still take decades or centuries to actually break down. Other products are made from materials which undergo a more rapid breakdown than non-biodegradable products. The adoption of products made of compostable materials which also meet a variety of needs, such as containers for fluid containing products which rest in a damp or wet condition, has posed a significant challenge.

Corrugated board is a converted or remanufactured paper product. It is a layered structure that is usually die cut to form corrugated containers. It consists of a fluted corrugated medium sandwiched between sheets of linerboard. The simplest three-ply corrugated board structure is known as "double face." As recently as 1990, much of the linerboard was made entirely from virgin, long-fibred, softwood and kraft pulp. Today, however, these board grades contain sizeable percentage of recycled old corrugated containers (OCC) and many linerboards are made from 100% OCC.

OCC has a history of efficient recycling use. Today, most of this recycled material goes directly from retail chain stores to mills based on long-term contracts. The rest comes from municipal curbside collection and wastepaper dealers. Most OCC is used again to produce corrugating medium and linerboard in the production of boxboard with a lesser percentage of OCC used in packaging foodstuffs such as egg cartons and fruit separation.

Another source of pulp are the clippings which come from trimming and cutouts of cardboard boxes. These clippings are known as DLK which stands for double liner kraft.

"Repulping" refers to any mechanical action that disperses dry or compacted pulp fibers into a water slush, slurry or suspension. The action can be just sufficient to enable the slurry to be pumped, or it can be adequate to separate and disperse all the fibers. In a typical recycling process, bales of OCC are fed into a repulper where the material is disintegrated and the gross contaminants are removed. The resulting stock is pumped through pressure screens and cyclonic cleaners to remove oversized materials and foreign matter. The glue, staples, wax, and tapes originally used to assemble the corrugated box are also removed.

In the manufacture of paper and paperboard and of products made from same, petroleum derived paraffin waxes and synthetic polymers have been used for many years as moisture retardants, water repellents, oil repellents, stiffeners, strengtheners, and release agents. Paper and paperboard coated or impregnated with petroleum waxes resist biodegradation and composting when disposed of in landfills and other waste disposal systems. Besides paraffin, the material used most often in such paperboard products is polyethylene. However, other widely used polymers in the field include polymerized acrylics, vinyls, styrenes, ethylenes and copolymers or hetero-polymers of these monomers.

The paper and paperboard to which most coating materials are applied is difficult to repulp and recycle in standard paper mill processes because the petroleum derived polymers and, particularly, the petroleum waxes are non-biodegradable in mill white waters (circulated process waters) and discharge effluents. Furthermore, the residue of the petroleum waxes that is not removed from pulp fibers during the repulping and recycling processes causes severe problems due to buildup that occurs on the screens and felts used during the process of forming and making the paper or paperboard sheet. Paper and paperboard coated or impregnated with traditional synthetic polymers and hetero-polymers are also difficult or impossible to repulp and recycle owing to their resistance to separation from the fiber in the standard repulping processes resulting in significant fiber losses in efforts to repulp and recycle them. These products are also non-biodegradable and therefore resist composting.

Water repellent packaging currently utilizes petroleum based liquid polymers or polymer film laminates (including polyethylene or similar film laminates such as polyolefin, polyester, polyvinyl alcohol, polyvinyl acetate, polystyrene, polypropylene, and the like) which are recyclable after extensive treatment. All of the laminates require the installation of specialized repulping machinery that separates the pulp fibers from the laminated films and is far more expensive in terms of operating costs and/or recycled pulp fiber yields. Pulp is a lignocellulosic fibrous material prepared by chemically or mechanically separating cellulose fibers from wood, fiber crops or waste paper. The action of separating the fiber from the film damages some fibers causing the damaged fiber to be separated out of the recycled pulp and presented for reuse. The separated film waste carries some of the fibers out of the repulpate when its adherence is not interrupted by the repulping process. Likewise, coatings and impregnating products made from or based on paraffin waxes and/or similar petroleum derivatives can be repulped for recycling in specially configured repulping equipment that removes and separates the paraffin waxes; however, as in the laminated film repulping process, the more intense physical and chemical requirements of this repulping process coupled with the lost fibers that become trapped in paraffin wax wastes cause the recyclable repulped fiber levels to fall far below those of standard repulping processes. Moreover, boxes and containers made from paraffin waxes are not biodegradable and must be separated and deposited in separate landfill areas.

Recently hydrogenated triglycerides have been impregnated and coated on paper and paperboard to give the paper and paperboard similar qualities to paraffin waxes. Another desirable quality of hydrogenated triglyceride coated and/or impregnated paper, paperboard and corrugated material is that the same is repulpable and biodegradable. These hydrogenated triglyceride paper products have become more widespread in the last 15 years and now comprise a small but growing segment of the marketplace.

The use of hydrogenated triglycerides to treat paper and paperboard is known in the prior art. In one example, U.S. Pat. No. 2,840,138 issued Jun. 24, 1958 discloses the use of tallow fatty acids to impregnate and penetrate corrugated paper material to provide a wilt resistant material. Also, U.S. Pat. No. 4,752,637 issued Jun. 21, 1988 is directed to a method of treating fiberboard to have superior moisture resistance with various mixtures of hydroxy terminated esters such as tallow.

U.S. Pat. No. 6,103,308 issued Aug. 15, 2000 is directed toward a paper and paperboard coating composition using vegetable oil triglyceride as a paper coating while U.S. Pat. No. 6,201,053 issued Mar. 13, 2001 is directed toward various triglycerides mixed with catalysts for use as a waterproofing agent on paper coating.

U.S. Pat. No. 6,846,573 issued Jan. 25, 2005 discloses the use of hydrogenated triglycerides having a melting point above 50° as a coating material for the surface of paper products to improve wet strength and moisture resistance in addition to being repulpable.

U.S. Pat. No. 8,455,068 issued Jun. 4, 2013 and U.S. Pat. No. 8,551,585 issued Oct. 8, 2013 disclose production of a moisture resistant poultry box using a cardboard impregnated with hydrogenated triglycerides and backing boards coated with polyethylene terephthalate (PET).

The use of plastic and Styrofoam® containers and trays for packaging and distributing food are widespread in the marketplace as are trays and containers made from polystyrene and polypropylene. However, trays and containers made from plastic and Styrofoam® are less eco-friendly than ones made from more biodegradable materials such as paper and cardboard. Molded paper pulp trays are degradable; however traditional molded trays from recycled old corrugated containers provide less structural rigidity than those of Styrofoam® and plastic. The need for improved structural stability is particularly pronounced with respect to single compartment trays made from paper pulp material particularly when the same is used in moist conditions. There is currently a need for molded pulp containers which are biodegradable, are easy to open and close but at the same time have the necessary strength and resist leaks. This is particularly true for fresh poultry, seafood and beef containers as these food products release fluid when sitting in the container and the containers are prone to leakage. This leakage can present health problems as well as present a poor sales appearance when placed in a store for sales. The moisture and leak resistance must also be maintained where the container is tilted or stacked at an angle, causing the liquid (blood, water, body fat) contained therein to be spilled.

Styrofoam® containers are widely used in the food industry. For example, fast food restaurants use molded Styrofoam® trays and drink containers. Manufacturers use Styrofoam® for product packaging in the forms of rigid end caps, corner guards, trays, bracing and blocking to provide structural integrity and protect goods from damage during transport. Distributors use Styrofoam® bulk food trays and containers. Currently, Styrofoam® trays are used to package and sell poultry, meats such as beef and pork and seafood products. Gardeners use Styrofoam® as a container for plants. However, the problem with Styrofoam® products is that they are not biodegradable and reusable, do not compost and occupy large areas in waste disposal.

Containers having a tray formed of molded paper pulp are often seen as an environmentally friendly option. However, the physical properties of the paper and corrugated board pulp material and the production processes of converting the pulp material into usable containers make it difficult to produce a pulp container or tray having sufficient strength to prevent tearing or puncture with leak resistant properties.

Molded pulp trays and containers provide the added benefit of using recycled material without the drawbacks of non-sustainable materials. Molded pulp products which are thermoformed are created entirely from recycled paper, making it one of the most sustainable and environmentally friendly solutions. This is beneficial because paper accounts for approximately at least 40% of municipal waste. In fact, the United States alone uses more than 100 million tons of paper each year. The paper industry is the third largest consumer of energy in the United States, and is one of the largest water polluters in the world.

Recycled paper ameliorates many of these deleterious impacts. For example, recycled paper uses 60-70% less energy to produce than virgin pulp. Recycled paper uses 55% less water, reduces water pollution by 35%, reduces air pollution by 74% and eliminates many toxic pollutants. Furthermore, recycled pulp helps preserve forests by reducing the need for loggers to cut new timber.

Molded paper pulp products are porous and quickly absorb moisture. Saturated with moisture, molded paper pulp loses its rigidity and begins to deteriorate.

Currently, molded paper pulp products are among the fastest biodegradable products known. Generally they take only two to five months to fully biodegrade under normal conditions.

It is, therefore, desirable to provide a recyclable tray product and a method for making same that combines the biodegradability of molded pulp container with the utility of a Styrofoam® container to replace Styrofoam® container currently in use.

SUMMARY OF THE INVENTION

The present invention is directed to a molded food tray product and a process for producing same which uses pulp slurry dry clippings from cardboard box or carton manufacturing DLK cardboard and liner board previously coated and/or impregnated with hydrogenated triglycerides. The pulp containing the mixture is thermo-molded into the tray form and coated with a polyester or a styrene/acrylic.

In accordance with another embodiment, there is provided a process for forming a polyester or styrene acrylic sprayed molded recycled paper protein tray thermo-formed from a mixture of standard paper pulp derived from DLK clippings which have been coated and/or impregnated with hydrogenated triglycerides. Ulterion 2100, 2050 polyesters are added to the pulp mixture prior to the tray molding to enhance the performance. The composite pulp mixture is thermo-molded into formed food containers. An aqueous dispersion with a water-dispersible polymer such as polyester or styrene acrylic is sprayed on both the top and bottom surfaces of the molded pulp tray and heated at a temperature and for a time sufficient to dry and cure the polyester and/or styrene acrylic spray coating to the exterior cellulosic fibers on the surface of the molded tray.

It is an object of this invention to produce a paper tray product out of a mixture of repulped DLK which have been previously coated and/or impregnated with hydrogenated triglycerides by thermo-molding the mixture into the desired container shape.

It is another object of the invention to produce a food tray out of recycled paper which is biodegradable.

It is yet another object of the invention to produce a food tray for poultry, meat or seafood which is moisture resistant.

It is another object of the invention to produce a poultry tray using pulp taken from paper clippings of hydrogenated triglyceride treated paper and cardboard which is stronger than equivalent trays made of 100% pulp obtained from untreated pulp clippings.

It is still another object of the invention to produce a protein tray out of recycled paper pulp derived from hydrogenated triglyceride DLK which has a strength similar to current Styrofoam® protein tray.

The invention will be better understood and objects other than those set forth above will become apparent when consideration is given to the following detailed description thereof. Such description makes reference to the annexed drawings herein.

BRIEF DESCRIPTION OF THE DRAWINGS

FIG. 1 is a perspective view of a prior art poultry tray;

FIG. 2 is an enlarged cross sectional view of the prior art poultry tray of FIG. 1 taken along line 2'-2';

DETAILED DESCRIPTION OF THE INVENTION

Figure 3:
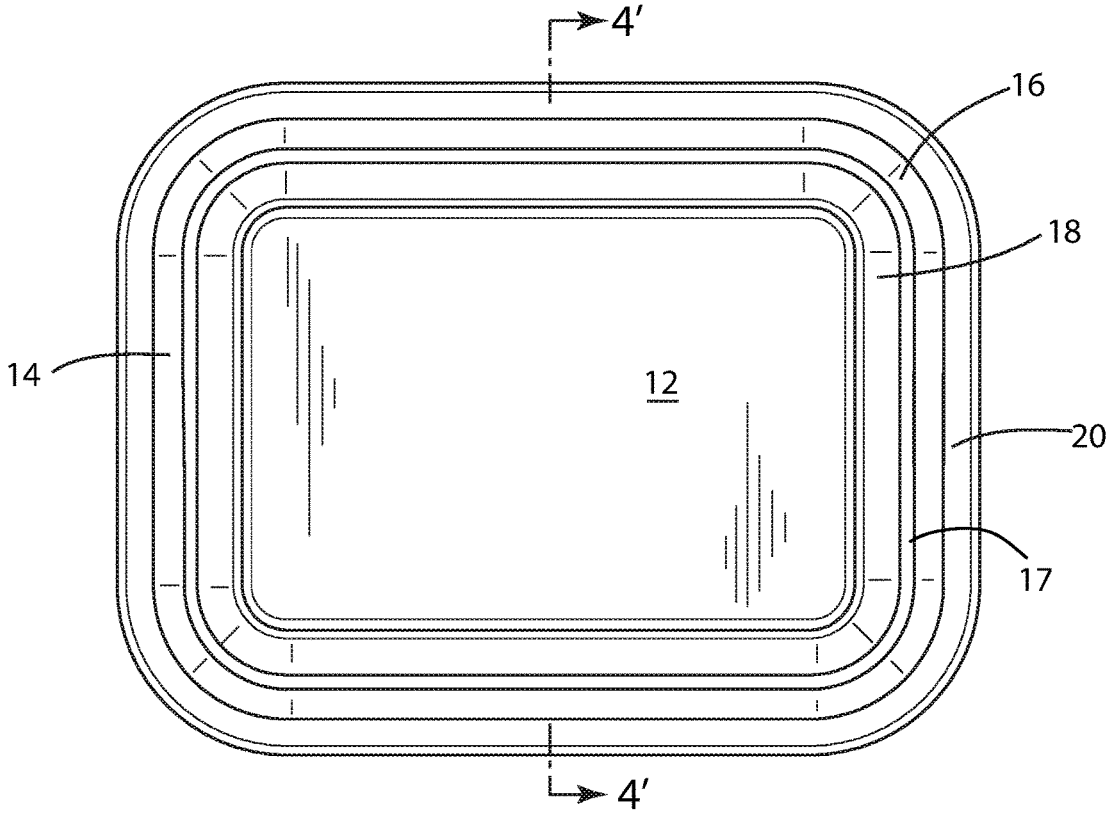
FIG. 3 is a top plan view of the inventive food tray invention.
Figure 4:
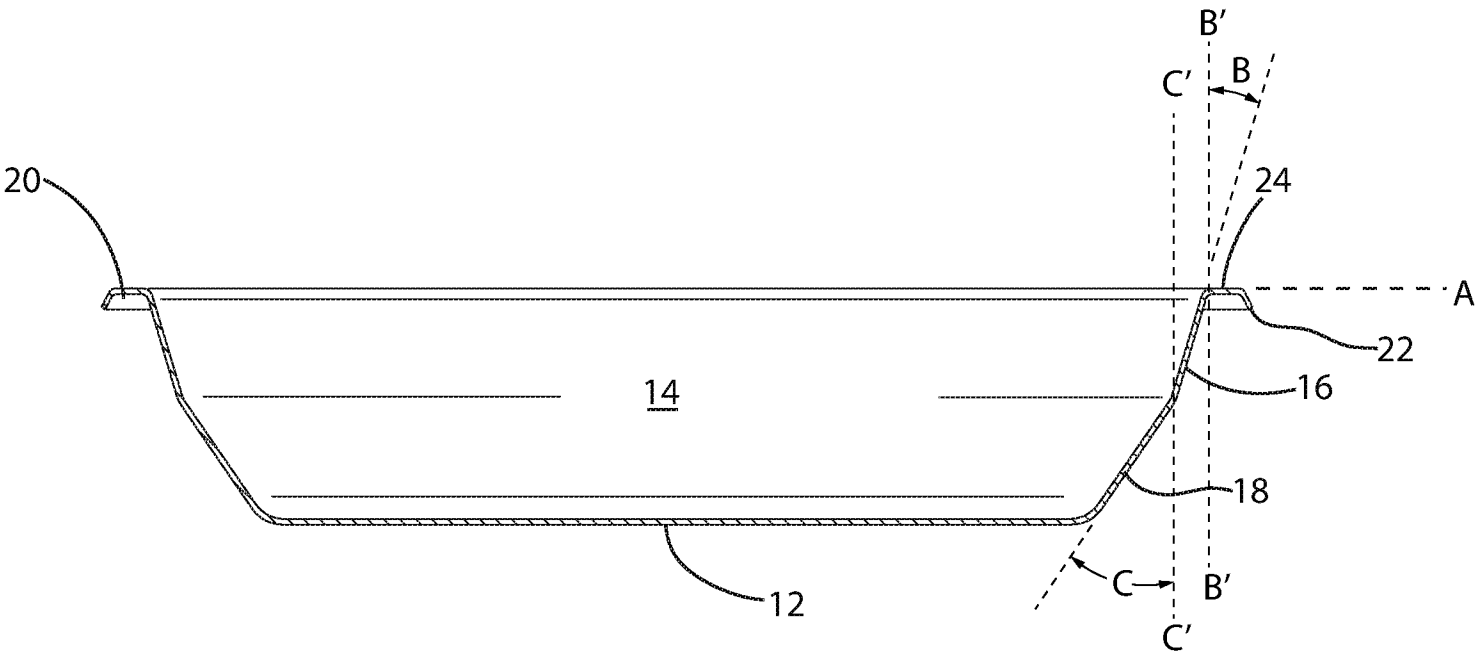
FIG. 4 is an enlarged cross sectional view of the inventive food tray of FIG. 3 taken along line 4'-4'.
Figure 5:
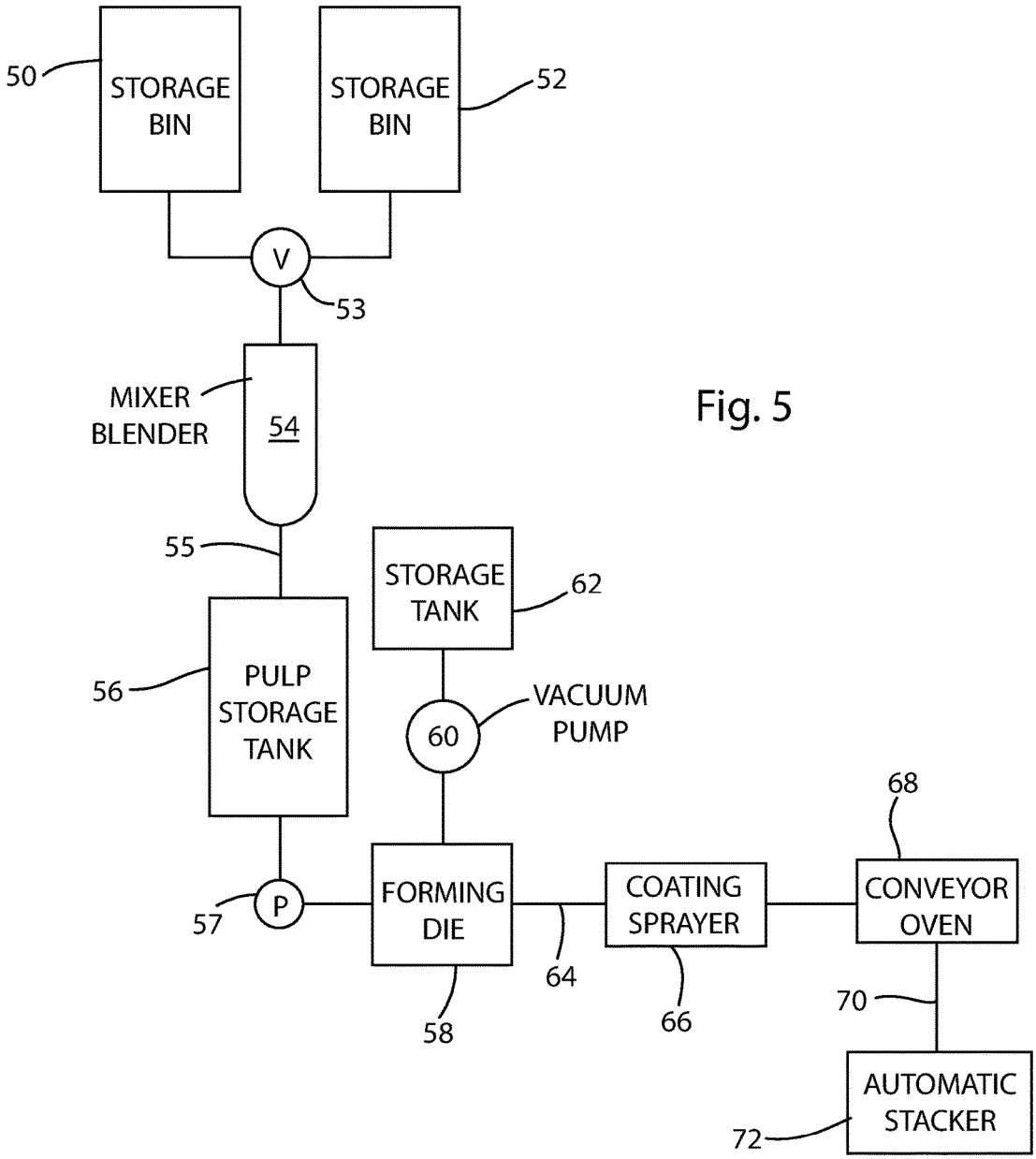
FIG. 5 is a schematic of the process used in making the inventive thermo-molded coated food tray.

The preferred embodiments and best mode of the invention are shown in FIGS. 3 through 5. While the invention is described in connection with certain preferred embodiments, it is not intended that the present invention be so limited. On the contrary, it is intended to cover all alternatives, modifications, and equivalent arrangements as may be included within the spirit and scope of the invention as defined by the appended claims.

Definitions

As used herein the following abbreviations and terms are understood to have the meanings as set forth:

The term "Triglyceride" includes both animal fats and vegetable oils and is derived from one or both of them. Animal fats include beef tallow, pork lard, poultry grease and fish oils. Vegetable oils include soybean oil, peanut oil, olive oil, palm oil, coconut oil and cottonseed oil.

The term "Paper" includes substrates and surfaces of cellulosic material.

The letters "DLK" (double lined kraft) refer to clippings from cardboard boxes when the same are trimmed and cut out in the box making process.

GREENCOAT® is a registered trademark which identifies paper and cardboard coated and/or impregnated with hydrogenated triglyceride which when repulped still contains cellulosic fibers containing hydrogenated triglycerides.

The method and machinery or equipment for repulping and recycling scrap paper in the paper and paperboard or liner board industry is both an established and well known art, and the equipment required is standard and commonly installed at most mills incorporating recycled paper in their manufacturing feed stocks. Thus, those skilled in the paper making art are also knowledgeable in re-pulping and recycling.

Protein trays are unique paper products that need to withstand leakage of water and fluid from the contained food. Typical use of such trays includes holding poultry, seafood, and meat. The present food tray matches or exceeds equivalent Styrofoam® trays with an acceptable strength with a minimized rim width to reduce fingernail punch through.

The present repulpable degradable thermo-molded poultry tray 10 is constructed of a mixture of recycled paper and cardboard clippings (DLK) coated and/or impregnated with hydrogenated triglycerides. Hydrogenated triglycerides typically used for coating and impregnation of paper products are animal fats and vegetable oils. Animal fats include beef tallow, pork lard, poultry grease and fish oils. Vegetable oils include soybean oil, peanut oil, olive oil, palm oil, coconut oil and cottonseed oil. The pulp used for the pulp mixture forming the composition of the molded food containers is preferably about 100% hydrogenated triglyceride impregnated cardboard clippings (HTIC) DLK. A food container made of 100% (HTIC) pulp has superior strength to a food container made of 100% OCC pulp. The percentage is shown in Table I on page 13.

The paper pulp mixture is pulped and diluted into a slurry consisting of a low percentage of pulp which is well known in the art. The slurry is pumped into a mold tool where it is thermo-molded into a tray 10 having a wall thickness ranging from about 1/16 inch to about 1/4 inch. The tray 10 is formed in heat forming molds which form the molded tray products which have the appearance of plastic material. The trays 10 are ejected from the heated mold in a semi-finished state and carried through a spray conveyor. The trays are coated on the exterior top and bottom surfaces of the tray with a polyester or copolymer, preferably styrene acrylic as shown in FIG. 5 by spray nozzles for a spray time of three seconds to 3½ seconds. The tray is sprayed on the top and bottom surfaces with about 3.0 to 3.5 grams on each side of a polyester or a copolymer styrene acrylic coating solution prior to entering the IR drying section where curing and drying takes place. The total wet coat weight of the polyester coating is about 7 grams. The trays 10 leave the sprayer and are dried on an IR drying conveyor at a temperature ranging from 300° F. to 350° F. for 5 to 10 seconds.

The tray 10 is preferably a simple compartment tray having a plane A taken across planar surface 24 of an opposing rim or flange 20 as seen in FIG. 4. The tray has a flat bottom 12, a continuous sidewall 14 with an upper sloped section 16 sloped inward at about a 70° to about a 80° (angle B), preferably 75°, taken from a line B'-B' which is perpendicular to the planar horizontal line A and an integral second lower sloped portion 18 sloped inward about 50° to about 60° (angle C), preferably about 50°, taken from a line C'-C' which is perpendicular to the same planar horizontal line A. Both sections 16 and 18 are integrally connected together by an arcuate intermediate section 17. The flange 20 allows for sealing the top of the tray 10 with a lidding film (not shown). The integral two stage sloping sidewall gives greater strength to the tray as well as providing a minimized area exposed to finger punch-thru risk. The sidewall 14 and bottom 12 form an interior volume of a substantially rounded rectangular shape of the tray. The flange or rim 20 is integrally formed with the upper edge of sidewall section 16 and extends peripherally outward. The flange end tip 22 is bent downward approximately 60° from a planar line A. The flange 20 allows a minimum deflection of the tray 10 during wrapping and resists puncture. The exterior dimensions of the tray range from 0.5-1.75 inches high, 5 to 8 inches wide and 8 to 15 inches long. It has been found that clippings from hydrogenated triglyceride containing cardboard converted to pulp to and then thermo-molded is stronger than a tray made of 100% DLK pulp made from untreated cardboard. The HTIC pulp when formed into the present protein tray provides a substitute for Styrofoam® trays presently in the marketplace.

The inventive pulp protein tray disclosed above is equivalent to the strength of a Styrofoam® tray.

TABLE I

Test Results Indexed to 176 g/m$^2$ Basis Weight

| | Ring Crush (lb/in) | | STFI (lb/in) | | Taber Stiffness (Taber Stiffness Units) | | Mullen Burst |
|---|---|---|---|---|---|---|---|
| Sample ID | MD | CD | MD | CD | MD | CD | (psi) |
| 100% dry clippings DLK | 70.38 | 37.54 | 23.44 | 8.05 | 107.11 | 40.99 | 60.77 |
| 100% Greencoat ® | 78.6 (+1.2%) | 41.24 (+1.0%) | 25.96 (+1.1%) | 8.38 (+0.4%) | 117.48 (+1%) | 41.31 (+0.1%) | 63.19 (+0.4%) |

In the present Table I shown above, the base reference is made to a 100% paper sheet and a 100% GREENCOAT® or HTIC paper sheet. The term GREENCOAT® is a registered trademark of Interstate Corrpack LLC and is used to designate a recyclable cardboard liner board and corrugated cardboard which is impregnated with hydrogenated triglycerides or coated with a copolymer styrene acrylic which is used on various GREENCOAT® paper products sold by Interstate Corrpack LLC.

It was surprisingly found that a tray of a 100% HTIC pulp mixture had a Ring crush, strength and stiffness which was greater than a tray of a standard DLK pulp mixture. This GREENCOAT® paper material was about 12% greater in the machine direction Ring Crush tests (compression strength) and 10% stronger in the cross direction than 100% normal DLK. Both the machine direction and cross direction of the STFI test was higher than that of the 100% normal DLK. The HTIC paper material also was about 10% greater in the machine direction for Taber Stiffness (flexural rigidity) and 5% greater in the Mullen Burst (psi) test than 100% standard paper material. The Mullen Burst (psi) relates to puncture resistance.

At the end of the pulping process, but before the molding begins, chemical additives are added to the pulp such as Ulterion 2050 and Ulterion 2100. The typical sequence would be to add the Ulterion 2050 first from vat 50 by selection valve 53, and then add the Ulterion 2100 from vat 52 and then mixed in blender 54 with the HTIC slurry. The mixture passes through line 55 into the pulp storage tank 56. Additionally, PAC (polyaluminum chloride) and AKD (alkyl ketene dimer) are added to assist the Ulterion products in adhering to the paper fibers.

Following the pulping and mixing process, the pulp is diluted to a low consistency of fibers. This can be done in a holding tank 56. Once the target consistency is reached, the slurry is pumped to the thermoforming machines or forming dies 58 via pump 57 where the trays are formed and fluid removed by vacuum pump 60 into storage tank 62. After the trays are formed, they are conveyed 64 to the spraying section.

A coating is applied to the outer upper surface area of the molded tray shown in FIGS. 3 and 4 and the bottom surface of the tray. The coating is a water based polymer such as a polyester (Ulterion 535). The coating is fast drying, recyclable, repulpable and is printable. After the spray application, the tray coating was dried in an IR heater at a temperature range from about 300° F. to about 350° F. for 5 to 10 seconds to cure and dry the polymer on the fibers of the thermo-molded tray. There is no sticking of the trays when the trays are stacked.

After the trays leave the sprayer coater 66, they are placed onto the IR drying oven conveyor 68 using compressed air or other transportation means such as a slide or adjacent transport conveyor and are dried. The trays are cured in the IR conveyor oven dryer 68 to cure the polymer coating. The trays travel through the conveyor oven 68 which is heated at about 300° F. to about 350° F. The coated dried trays can optionally be carried by conveyor 70 from the conveyor oven 68 to an automatic stacker 72 which stacks the trays for shipment.

The wrapping material (not shown) for the tray can be any conventionally used and available film overwrap. One example is Cryover BDF-2001 film that is a coextruded polyolefin shrink film. If desired, the overwrap can be a clear plastic film allowing the food product contained in the tray to be seen and displayed in the packaging.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A repulpable moisture resistant and recyclable protein tray formed of thermo-molded pulp having a planar base and an integral sloped sidewall forming an interior volume, said tray comprising a thermo-molded structure made of a pulp mixture derived from DLK (double lined kraft) clippings impregnated with hydrogenated triglyceride, said molded tray having an exterior surface coated with a polymer having characteristics which provide moisture resistance and wet strength to said molded tray, said molded tray being repulpable and recyclable.

2. The repulpable moisture resistant molded protein tray of claim 1 wherein the hydrogenated triglyceride of said recycled paper is a hydrogenated vegetable oil selected from the group consisting of soybean oil, peanut oil, olive oil, palm oil, coconut oil and cottonseed oil.

3. The repulpable moisture resistant molded protein tray of claim 1 wherein the hydrogenated triglyceride of said recycled paper is an animal fat selected from the group consisting of beef tallow, pork lard, poultry grease, and fish oils.

4. The repulpable moisture resistant molded protein tray of claim 1 wherein said coating polymer is a water based polyester.

5. The repulpable moisture resistant molded tray of claim 2 wherein said protein tray is directed toward protein consisting of poultry, seafood and meat.

6. The repulpable moisture resistant paper tray of claim 1 wherein sidewall is two separate contiguous sloped sections comprising an upper sloped section from at an about 70° to about 80° angle from a plane drawn across said peripherally extending flange and a lower sloped section formed at an angle about 50° to about 70° from said plane drawn across said peripherally extending flange.

7. A repulpable moisture resistant paper container comprising a thermo-molded composite container made of pulped DLK containing hydrogenated triglyceride, said container defining a base, an integral outwardly sloped sidewall extending upward from said base, a flange extending outward from an upper edge of said sloped sidewall, said flange, sidewall and base having a surface coated with an emulsified mixture of styrene acrylic to provide moisture resistance and wet strength to said thermo-molded container, said thermo-molded container being repulpable and recyclable.

8. The repulpable moisture resistant paper container as claimed in claim 7 wherein said base is planar and said flange defines a planar surface parallel with said planar base with outward edge of said flange being bent downward from a plane drawn across said flange at an angle in a range of about 50° to about 70°.

9. The repulpable moisture resistant paper container of claim 8 wherein sidewall is two separate contiguous sloped sections comprising an upper sloped section from at an about 70° to about 80° angle from a plane drawn across said peripherally extending flange and a lower sloped section formed at an angle about 50° to about 60° from said plane drawn across said peripherally extending flange.

10. The repulpable moisture resistant paper container of claim 8 wherein said paper container is a single compartment tray formed of said mixture of thermo-molded pulp defining a planar base and an integral sloped sidewall forming an interior volume, the tray further comprising an integral flange having a planar surface extending peripherally outward from an upper edge of said sidewall.

11. A process for making a repulpable and recyclable food tray comprising the steps of:

a). mixing a recycled pulp medium previously treated with hydrogenated triglyceride (HT);

b). adding Ulterion 2050 to the pulp medium;;

c). thermo-molding the homogenous mixture into trays;

d). coating each molded tray with at least one coating of polyester; and e). drying said each coated tray with a heater dryer to dry said coating.

12. A process as claimed in claim 11 wherein said polyester is in a water solution and is applied at about 7 grams wet weight to the top surface and bottom surface of the tray.

13. A process as claimed in claim 11 wherein step d) coating is done by spraying.

14. A process as claimed in claim 11 wherein said polyester coating is a styrene acrylic.

15. A process for making a repulpable and recyclable food as claimed in claim 11 wherein the drying step e) comprises:

heating each coated tray from about 300° F. to about 350° F. to dry the polymer coating for a period ranging from about 10 seconds to about 15 seconds.

16. A process for making a repulpable and recyclable food tray as claimed in claim 11 including an additional step f) of stacking said cured coated trays in stacks having a specific number of trays.

17. A process for making a protein container comprising the steps of:

a). mixing a recycled paper pulp medium previously treated with hydrogenated triglyceride (HT) into a homogenous slurry;

b). thermo-molding the homogenous slurry into protein containers;

c). coating each molded protein container with at least one coating of polymer;

d). curing said each coated container with a heater dryer at a temperature ranging from 300° F. to about 350° F. for a time suitable to dry the coating to cure said coating; and e). stacking said dried coated poultry containers in stacks having a specific number of containers.

18. The process for making a protein container as claimed in claim 17 wherein said paper pulp medium is in the form of cardboard clippings taken from cardboard containing hydrogenated triglyceride.

19. The process for making a protein container as claimed in claim 17 wherein said polymer coating is a polyester.

20. The process for making a protein container as claimed in claim 17 wherein said polymer coating is an acrylic styrene.

* * * * *